US006640992B1

(12) United States Patent
Berger et al.

(10) Patent No.: US 6,640,992 B1
(45) Date of Patent: Nov. 4, 2003

(54) TUMBLER

(76) Inventors: Jennifer N. Berger, 3203 Hamm Rd., Pearland, TX (US) 77581; David Berger, 3203 Hamm Rd., Pearland, TX (US) 77581

( * ) Notice: Subject to any disclaimer, the term of this patent is extended or adjusted under 35 U.S.C. 154(b) by 0 days.

(21) Appl. No.: 10/369,453

(22) Filed: Feb. 20, 2003

(51) Int. Cl.[7] ..... A47G 19/22
(52) U.S. Cl. ..... 220/603; 220/710.5; 220/713
(58) Field of Search ..... 220/603, 710.5, 220/713, 719, 718

(56) References Cited

U.S. PATENT DOCUMENTS 2,601,767 A * 7/1952 Wall ..... 220/719
4,096,966 A * 6/1978 Korshak ..... 220/603
4,388,996 A * 6/1983 Panicci ..... 220/603
5,294,018 A * 3/1994 Boucher ..... 220/603

* cited by examiner

*Primary Examiner*—Joseph M. Moy

(57) ABSTRACT

The present invention discloses a toddler's drinking cup design to teach toddler's and children how to drink properly without a sucking motion. The three piece self-righting toddler's drinking cup comprising a lid with threads, a concave surface having a ledge encircling the outside of the lid comprising a slit adapted for drinking and an air venting hole(s); a cup with matching threads, a weighted rubber round bottom and two diametrically opposed handles; and an o-ring seal adapted for sealing the lid to the cylinder.

20 Claims, 2 Drawing Sheets

TUMBLER

BACKGROUND OF THE INVENTION

1. Field of the Invention

The present invention relates to a tumbler for use in connection with teaching a child to drink properly from a cup. Furthermore the present invention relates to a tumbler designed to be self-righting and minimize spilling of liquid 2. Description of the Prior Art Toddler's Tumbler is desirable to teach a child how to drink properly from a cup.

The use of cups designed to prevent spilling are known in the prior art. For example, U.S. Pat. No. 4,303,170 to Panicii discloses a self-righting training cup. However, the Panicci '170 patent does not contain an o-ring placed between the cover and the cup to aid in the sealing of these two parts so that liquid will not leak from where the two surfaces of the cover and the cup meet, and has further drawbacks of having a spout for drinking, which encourages children to develop improper drinking techniques.

U.S. Pat. No. 4,096,966 to Korshak discloses a self-righting cup with a weighted bottom. However, the Korshak '966 patent also does not have an o-ring for sealing the cover to the cup and accordingly suffers from the same setback as discussed for the Panicci '170 patent. Additionally the patent does not have a threaded cover and the receiving threads on the tumbler to aid in the sealing of the cover to the tumbler. Furthermore the bottom of the Korshak '966 patent is flat and is thus different from the rounded rubber bottom found on the current toddler's tumbler.

Similarly, U.S. Pat. No. Des. 2,601,767 to Wall discloses a self righting cup that has a round bottom. However, the Wall '196 patent does not have an o-ring to aid in sealing the cover to the cup, and also does not contain a cover with threads which can be threaded onto the matched threaded cup to further aid in sealing the top to the cup for prevention of liquid leakage.

Lastly, U.S. Pat. No. Des. 322,196 to Ohnuki discloses an infant's drinking cup. However, the Ohnuki '196 patent does not have a weighted bottom, and has the additional deficiency of not having an o-ring to aid in the sealing of the cover to the cup or a threaded cover and cup to provide additional aid in the sealing of the liquid in the inside of the cup.

While the above-described devices fulfill their respective, particular objectives and requirements, the aforementioned patents do not describe a toddler's tumbler that allows for training a child to drink without sucking from a spout like opening which could result in developing improper drinking techniques. The above patents make no provision for a toddler's tumbler possessing the previously mentioned attributes.

Therefore, a need exists for a new and improved toddler's tumbler that can be used for teaching toddler's how to drink properly and to minimize liquid from spilling by the use of an o-ring sealed placed between a threaded lid and matching threaded cup combined with a weighted self righting bottom. In this regard, the present invention substantially fulfills this need. In this respect, the toddler's tumbler according to the present invention substantially departs from the conventional concepts and designs of the prior art, and in doing so provides an apparatus primarily developed for the purpose of teaching toddlers how to drink from a cup in a proper manner and with the added features of an o-ring, threaded sealing cover and threaded sealing lid along with a weighted self righting bottom.

SUMMARY OF THE INVENTION

In view of the foregoing disadvantages inherent in the known types of toddler's or child's drinking cup now present in the prior art, the present invention provides an improved toddler's tumbler, and overcomes the above-mentioned disadvantages and drawbacks of the prior art. As such, the general purpose of the present invention, which will be described subsequently in greater detail, is to provide a new and improved toddler's tumbler which has all the advantages of the prior art mentioned heretofore and many novel features. This results in a toddler's tumbler that is not anticipated, rendered obvious, suggested, or even implied by the prior art, either alone or in any combination thereof. To attain this, the present invention essentially comprises a three piece self-righting toddler's drinking cup comprising a cover with a concave surface having a ledge encircling the outside of the cover comprising a slit adapted for drinking and an air venting hole; a cylinder, two diametrically opposed oval handles extending from the cylinder, and a base section connected to said cylinder comprising a round bottom interior, a round bottom exterior and a weight located between said bottom exterior and said bottom interior; an o-ring seal adapted for sealing the cover and cylinder together in a leak free configuration.

There has thus been outlined, rather broadly, the more important features of the invention in order that the detailed description thereof that follows may be better understood and in order that the present contribution to the art may be better appreciated.

The invention may also include a design or picture that is pleasing to the consumer such as but not limited to the design as shown in FIG. 2. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. In addition, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toddler's tumbler that has all of the advantages of the prior art as mentioned above and none of the disadvantages.

It is another object of the present invention to provide a new and improved toddler's tumbler that may be easily and efficiently manufactured and marketed.

An even further object of the present invention is to provide a new and improved toddler's tumbler that has a low cost of manufacture with regard to both materials and labor, and which accordingly is then susceptible of low prices of sale to the consuming public, thereby making such toddler's tumbler economically available to the buying public.

Still another object of the present invention is to provide a new toddler's tumbler that provides in the apparatuses and methods of the prior art some of the advantages thereof, while simultaneously overcoming some of the disadvantages normally associated therewith.

Even still another object of the present invention is to provide a toddler's tumbler for the purpose of teaching toddlers how to drink from a cup in a proper manner and with the added features of an o-ring, threaded sealing cover and threaded sealing lid along with a weighted self righting bottom all design to prevent the spilling of liquid during use.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
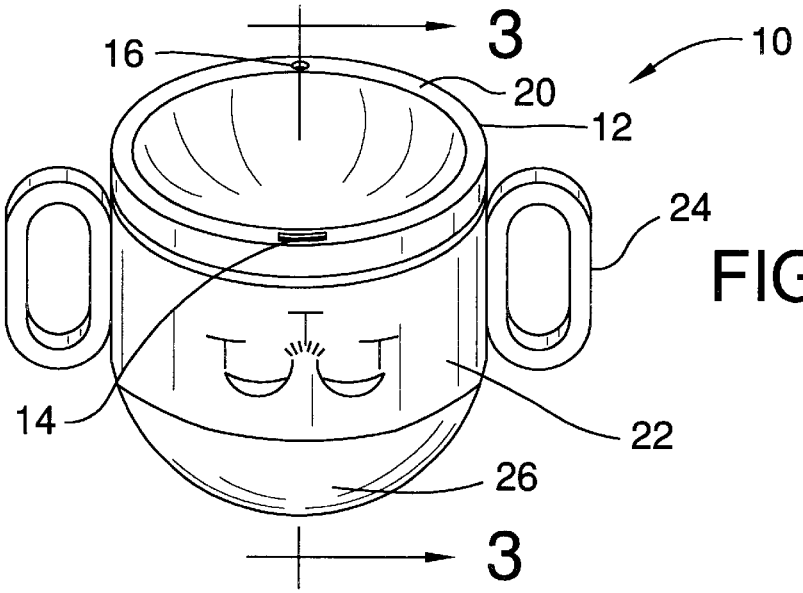
FIG. 1 is a front elevation view of a preferred embodiment of the tumbler constructed in accordance with the principles of the present invention.

Referring now to the drawings, and particularly to FIGS. 1–4, a preferred embodiment of the tumbler of the present invention is shown and generally designated by the reference numeral 10.

In FIG. 1, a new and improved tumbler 10 of the present invention for teaching a toddler to drink properly and prevent spilling of liquid is illustrated and will be described. More particularly, the toddler's tumbler 10 has a cover 12. The cover 12, consist of a sipping slot 14 and an air vent 16 located on the outer rim 20. The rim 20 of the cover can be from 0.01 to 1 inches thick and encircles the outside of the cover as shown in FIG. 1. The cover 12 has a concave interior surface 18, which helps to prevent the spilling of liquid by collecting liquid. Preferably the cup 10 has the sipping slot 14 diametrically opposed to air vent hole 16. Sipping slot 14 can have a width of 0.1 to 1 inches, and preferably the size is determine so as to allow for small quantities of liquid to exit the tumbler for a child to drink. Air vent hole, 16, is sized to allow the air pressure to equalize between the inside of the cup and the outside.

The tumbler also includes a cylinder shaped body 22, on which a logo may be placed, an example is the design showing three T's shown in FIG.1. Two handles 24, are positioned on the cup 22, diametrically opposed to each other. The handles are oval in shape and can be made with varying thickness as deemed appropriate for ergonomic purposes. The toddler's tumbler includes an o-ring, 32 situated between the cover 12 and the cup 22 to aid in sealing the cover 12 to the cup 22 as shown in FIG. 1. Additionally the tumbler consists of a rubber bowl shaped bottom 26. In certain embodiments the toddler's tumbler can include a plurality of air vents. For example, the cover 12 may have one rectangular sipping hole 14 and three small circular air vents 16 located on the opposite side of the cover 12 as shown in FIG. 1.

Figure 2:
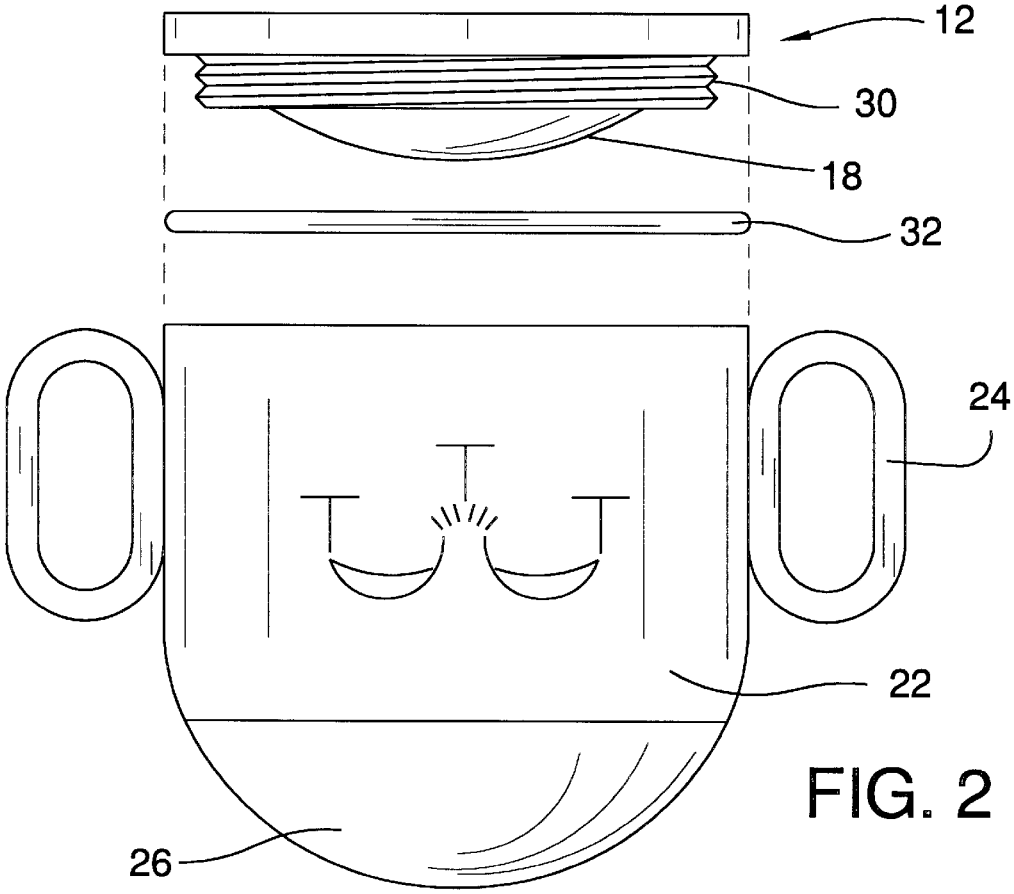
FIG. 2 is an expanded view of the tumbler of the present invention.

In FIG. 2, further embodiments of a new and improved tumbler 10, is illustrated and is further described. A frontal view of the toddler's tumbler with the different components separated for clarity is shown. The toddler's tumbler includes a cover 12 with threads 30 encircling the outside of the bottom of the cover 12, a rubber o-ring 32, which when aligned properly, as represent by the dotted lines, with the cup 22 allow the cover 12 to be threaded on to the matching threads of cup 22 to form a seal against liquid leaks when used for drinking. FIG. 2 shows a frontal view of the toddler's tumbler with the different components separated for clarity. Also included with the toddler's tumbler is an o-ring 32, which further aids in providing a seal between cover 12, and cylinder 22 when the cover 22 is threaded onto cylinder 22 as shown in FIG. 2. Additionally FIG. 2 shows oval handles 24 attached to cup 22 and arranged so that they are on opposite sides of the cup 22. In the middle of cup 22 is a logo consisting of Three T's and graphic design, any logo could be used in place of this preferred embodiment. Furthermore, FIG. 2 contains a frontal view of the rounded rubber bottom 26, which is attached to the bottom section of cup 22.

Figure 3:
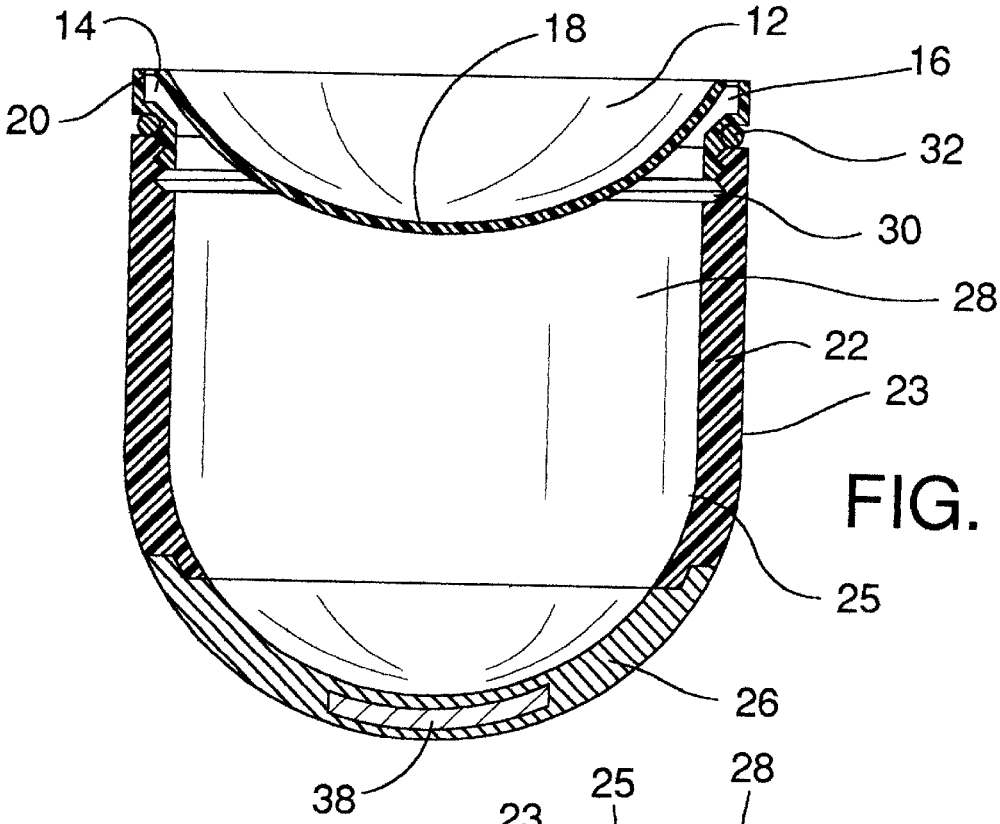
FIG. 3 is a cutaway side view of the tumbler of the present invention clearly showing the concave cover, the rubber o-ring seal, the uniformly thick sidewalls of the cylinder; the rubber bottom, and the weighted bottom section.

In FIG. 3, a further embodiment of a new and improved tumbler 10, is illustrated in a cutaway view wherein cover 12 with threads 30 is shown connected to receiving threads 34 with the rubber o-ring 32. The o-ring may be located in an o-ring channel between the cover 12 and cup 22. The threads 30, receiving threads 34 and o-ring 32 are provided to ensure a no leak seal between the cover 12 and the cup 22. Additionally the walls of cup 22 are shown to be of the same uniform width as the walls of the rubber bottom 26 to which it is connected. The toddler's tumbler 10 has an outer wall 23 and in inner wall 25 which is part of the cavity 28 in which the liquid is contained.

A further aspect of the invention shown in FIG. 3 is weight 38 shown located at the center of rubber bottom 26. The weight 38 helps in keeping the cup in an upright position to prevent the spilling of the liquid contained within the tumbler by providing a center of gravity that restores the toddler's tumbler 10 to an upright or substantially upright position after it is tipped over. The weight 38 can be made from a metal material or any other material weighing 0.5, 1, 2, 3, 4, 5, 6, 7, 8, 9, 10, or more ounces or any intermediate weight. The weight 38 may be shaped into any shape that will fit into the space between the outside and inside walls of the tumbler's bottoms. The weight 38 shown in FIG. 3 is uniform in width. In a further embodiment the weight can be a flat oval shape, a flat circular shape, a flat square shape, or a flat rectangular shape.

Figure 4:
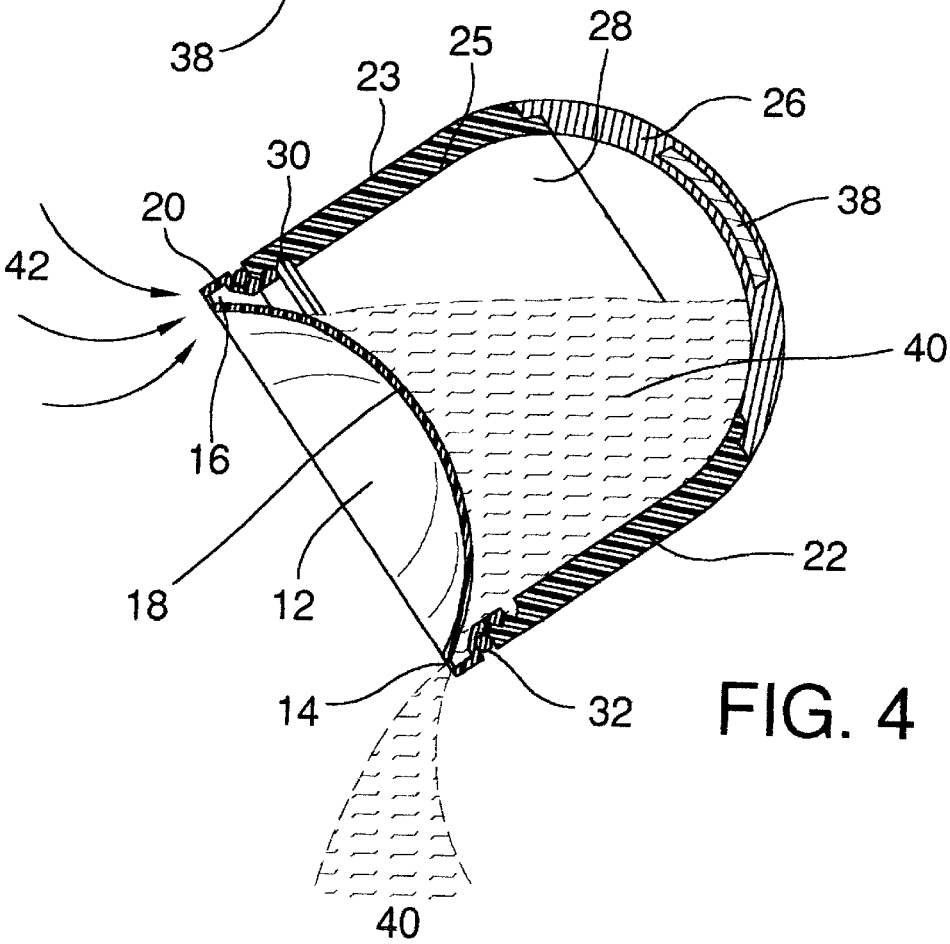
FIG. 4 is a cutaway side view of the tumbler of the present invention clearly showing the liquid exiting the sipping hole and air entering the air vent, and no leaking occurring with the seal.

In FIG. 4, further embodiments of a new and improved tumbler 10, is illustrated in a cut away side view wherein liquid 40 is shown to be draining from sipping hole 14 while air 42 is entering air vent 16. The figure also illustrates that there is no leak or spill, occurring between cover 12, o-ring 32 and cylinder 22 when the toddler's tumbler 10 properly sealed together.

While a preferred embodiment of the toddler's tumbler has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any plastic or moldable material may be used for the toddler's tumbler. It may be formed with patterns and/or bright colors to be pleasing to the toddler's or parent's eye. The material may be colored throughout or a color may be painted on the surface. In addition, although a child's cup has been described, it should be appreciated that the toddler's tumbler herein described is also suitable for adult use when spilling may be a problem.

As used herein, the terms "approximately" and "about" means within 25% of the stated value, or more preferentially within 15% of the value. As used herein in the claim(s), when used in conjunction with the word "comprising", the words "a" or "an" may mean one or more than one. As used herein "another" may mean at least a second or more.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A three piece self-righting drinking cup comprising:

a cover with a concave surface having a ledge encircling the outside of the top of the cover comprising a slit adapted for drinking and an air venting hole and threads encircling the outside of the bottom of the cover;

a cup with a weighted rubber round bottom and two diametrically opposed handles; and an o-ring seal adapted for sealing the cover to the cup.

2. The cup of claim 1, wherein said air venting hole is diametrically opposed to said slit for drinking.

3. The cup of claim 2, wherein said hole for venting is 0.1 to 1 inches from the edge of the lid.

4. The cup of claim 2, wherein said slit for drinking is 0.1 to 1 inches from the edge of the lid.

5. The cup of claim 1, wherein said lid is threaded on the bottom to allow for attachment to said cylinder.

6. The cup of claim 5, wherein said lid comprises a second o-ring adapted to be placed flush with the bottom of the lid and above the bottom section of said threaded lid.

7. The cup of claim 5, wherein said cylinder has threaded grooves to allow for attachment to said lid.

8. The cup of claim 5, wherein said cup has a diameter of 1 to 3 inches measured from the edge of the lid to the center of the circular lid.

9. The cup of claim 1, wherein said cylinder's wall is uniform in width.

10. The cup of claim 9, wherein said cylinder's wall is 0.1 in to 0.25 in thick.

11. The cup of claim 1, wherein said two handles consist of an oval shape and with an oval hole for allowing a toddler's fingers to hold onto.

12. The cup of claim 1, wherein said o-ring seal fits said lid and cup to form a leak-proof seal.

13. The cup of claim 1, wherein said cup is molded from plastic.

14. The cup of claim 1, wherein said o-ring is rubber or plastic.

15. A self-righting drinking cup comprising:

a lid with a concave surface having a ledge encircling the outside of the lid comprising a slit adapted for drinking and an air venting hole;

a cylinder with two diametrically opposed oval handles on the exterior; and a weighted central section located between the inside round bottom and the outside rubber bottom; and a rubber or plastic o-ring seal adapted for sealing the lid and cylinder together in a leak free configuration.

16. A self-righting toddler's drinking cup comprising:

a cover with a concave surface having a ledge encircling the outside of the cover comprising a slit adapted for drinking and a separate air venting hole both diametrically opposed;

a cup with a weighted rubber round bottom and two diametrically opposed oval handles; and an o-ring seal adapted for sealing the cover and cup together in a leak free configuration.

17. The cup of claim 16, wherein said weighted central section weighs 1 to 6 ounces.

18. The cup of claim 16, wherein said lid is threaded on the bottom to allow for attachment to said cylinder.

19. The cup of claim 18, wherein said lid comprises a second o-ring adapted to be placed flush with the bottom of the lid and above the bottom section of said threaded lid.

20. The cup of claim 18, wherein said cylinder has threaded grooves to allow for attachment to said lid.

* * * * *